US011098425B2

(12) United States Patent
Zieman et al.

(10) Patent No.: US 11,098,425 B2
(45) Date of Patent: Aug. 24, 2021

(54) MEASURABLE GUIDING TOOL FOR SEWING MACHINE

(71) Applicant: Clover Mfg. Co., Ltd., Osaka (JP)

(72) Inventors: Nancy L. Zieman, Beaver Dam, WI (US); Yuji Kawasaki, Osaka (JP); Chihiro Iwasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 106 days.

(21) Appl. No.: 16/588,384

(22) Filed: Sep. 30, 2019

(65) Prior Publication Data

US 2020/0109502 A1 Apr. 9, 2020

(30) Foreign Application Priority Data

Oct. 5, 2018 (JP) ..... JP2018-189756

(51) Int. Cl.
*D05B 35/12* (2006.01)

(52) U.S. Cl.
CPC ..... *D05B 35/12* (2013.01)

(58) Field of Classification Search
CPC ..... D05B 35/12; D05B 35/10; D05B 29/06; D05B 29/12
See application file for complete search history.

(56) References Cited

U.S. PATENT DOCUMENTS

| | | | | | |
|---|---|---|---|---|---|
| 1,053,548 | A * | 2/1913 | Tela | D05B 29/06 | 112/151 |
| 2,130,446 | A * | 9/1938 | Rakov | D05B 29/00 | 112/151 |
| 2,478,032 | A * | 8/1949 | Wallsh | D05B 29/00 | 112/151 |
| 4,899,677 | A * | 2/1990 | Frey | D05B 29/06 | 112/151 |
| 6,244,202 | B1 * | 6/2001 | Tsuta | D05B 73/12 | 112/260 |
| 2007/0215025 | A1 * | 9/2007 | Niizeki | D05B 35/12 | 112/153 |
| 2007/0266920 | A1 * | 11/2007 | Fujihara | D05B 29/12 | 112/313 |

FOREIGN PATENT DOCUMENTS

JP 3616233 B2 2/2005

* cited by examiner

*Primary Examiner* — Nathan E Durham
(74) *Attorney, Agent, or Firm* — Hamre, Schumann, Mueller & Larson, P.C.

(57) ABSTRACT

A sewing machine guiding tool includes a presser foot, a holder and a gauge. The presser foot includes a bottom wall and a rear support. The bottom wall is formed with a needle-passing hole and with a slit extending from the needle-passing hole to the front end of the bottom wall. The rear support is connected to the rear end of the bottom wall. The holder, attached to a presser bar of the sewing machine, holds the presser foot pivotally about a horizontal axis. The gauge, supported by the rear support to be slidable in parallel to the horizontal axis, includes a ruler plate and a guide portion. The ruler plate has a surface marked with a scale. The guide portion extends from the ruler plate. The ruler plate is disposed above the bottom wall with its surface inclined to become higher as proceeding rearward.

7 Claims, 9 Drawing Sheets

MEASURABLE GUIDING TOOL FOR SEWING MACHINE

FIELD

The present disclosure relates to a measurable guiding tool for a sewing machine.

BACKGROUND

A guiding tool for a sewing machine for use in sewing has conventionally been proposed. An example of such a guiding tool is disclosed in Japanese Patent No. 3616233. The guiding tool disclosed in this patent document is used as attached to a holder between a presser bar and a presser foot of a sewing machine. Specifically, this guiding tool includes a ruler holder to be attached to the holder of the sewing machine, and a guide bar having one end fixed to the ruler holder. A movable ruler holder that holds a guiding portion is slidably attached to the guide bar. The movable ruler holder can be fixed to a selected position of the guide bar with a screw. In use of such a sewing machine guiding tool, the guiding portion is fixed at a position spaced apart from the needle by a predetermined distance. Sewing is performed with the guiding portion aligned with a line of previously formed stitches. The guiding tool makes it possible to form stitch lines at predetermined intervals.

Generally, the above-described holder of a sewing machine, which is between the presser bar and the presser foot, is an attachment of the sewing machine, and its shape may vary depending on the type of the sewing machine. The conventional guiding tool described above is configured to be attached to such a holder of a sewing machine. Thus, such attachment may be difficult or impossible for some types of sewing machines. Thus, the conventional guiding tool has room for improvement in terms of versatility.

SUMMARY

In light of the above-described circumstances, an object of the present disclosure is to provide a guiding tool for a sewing machine which has improved versatility and can be conveniently used for various types of sewing machines.

According to an aspect of the present disclose, there is provided a guiding tool for a sewing machine, including: a presser foot including a bottom wall and a rear support, where the bottom wall includes a front end and a rear end, and is formed with a needle-passing hole between the front end and the rear end, while also being with a slit extending from the needle-passing hole to the front end, and the rear support is connected to the rear end of the bottom wall; a holder that is removably attached to a presser bar of the sewing machine and that holds the presser foot pivotally about a horizontal axis; and a gauge supported by the rear support in a manner slidable in a first direction parallel to the horizontal axis, where the gauge includes a ruler plate and a guide portion. The ruler plate has a ruler surface marked with a scale, and the guide portion extends from the ruler plate. The ruler plate is disposed above the bottom wall in a vertical direction, and the ruler surface is inclined so as to become higher as proceeding rearward.

Further features and advantages of the present disclosure will become apparent from the following detailed description with reference to the attached drawings.

DRAWINGS

EMBODIMENTS

Figure 1:
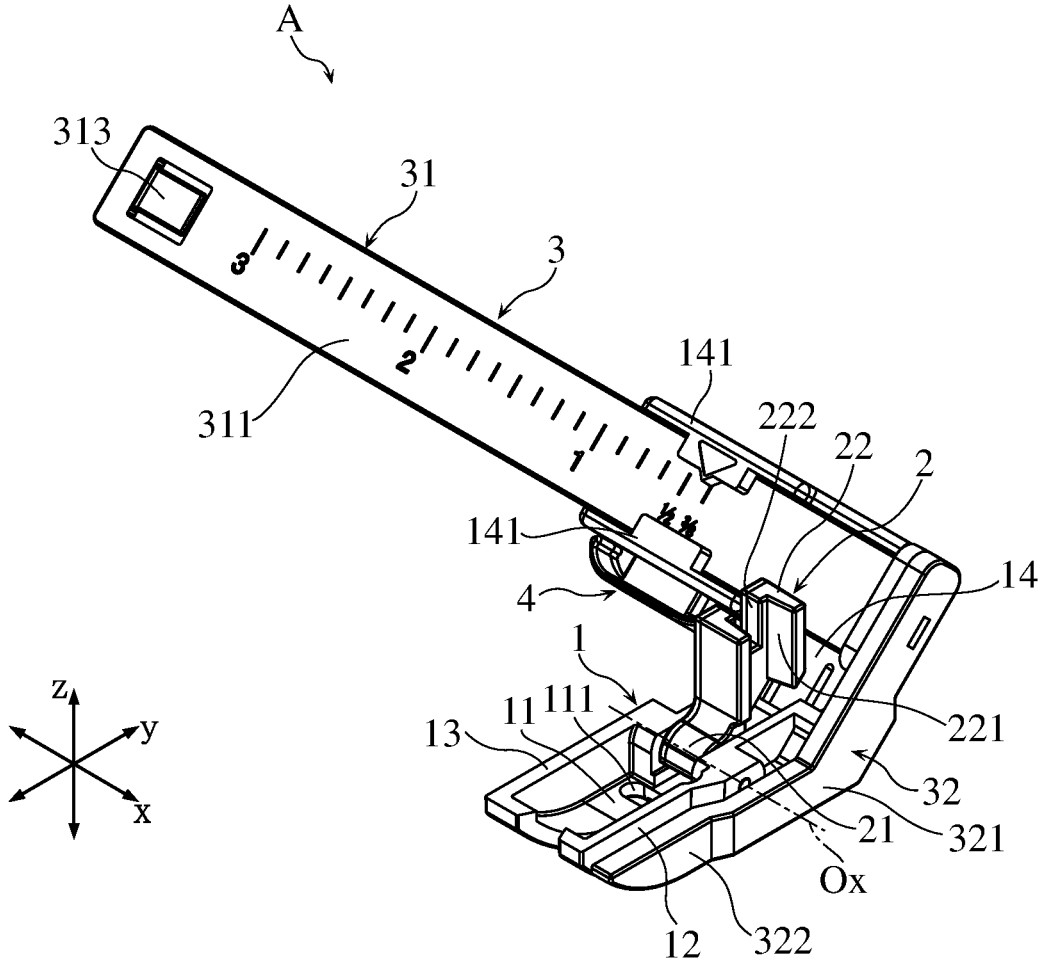
FIG. 1 is a perspective view showing a guiding tool for a sewing machine according to an embodiment.

Embodiments of a guiding tool for a sewing machine are described below with reference to the accompanying drawings.

FIGS. 1-8 show a guiding tool for a sewing machine according to an embodiment. The illustrated guiding tool A includes a presser foot 1, a holder 2 that holds the presser foot 1, a gauge 3, and an engagement member 4. Note that, in FIGS. 1-8, the direction y is the front-rear direction, the direction x is the lateral direction that is a horizontal direction orthogonal to the direction y (the first direction according to the present disclosure), and the direction z is the vertical direction.

The presser foot 1 includes a bottom wall 11, a pair of side walls 12, 13 and a rear support 14. The bottom wall 11 is a portion to press the fabric during sewing. The bottom wall 11 is generally flat except its extremity. The bottom wall 11 is formed with a needle-passing hole 111 through which the sewing-machine needle moves vertically, and a slit 112. The needle-passing hole 111 penetrates the bottom wall 11 in the thickness direction (direction z). The needle-passing hole 111 is elongated in the lateral direction (direction x). Because of the elongated needle-passing hole 111, the presser foot 1 is applicable to sewing with a large stitch width in the lateral direction (zigzag stitch). Unlike this, when the presser foot is designed exclusively for straight stitching, the needle-passing hole may not be elongated in the direction x (e.g. may be substantially circular).

Figure 2:
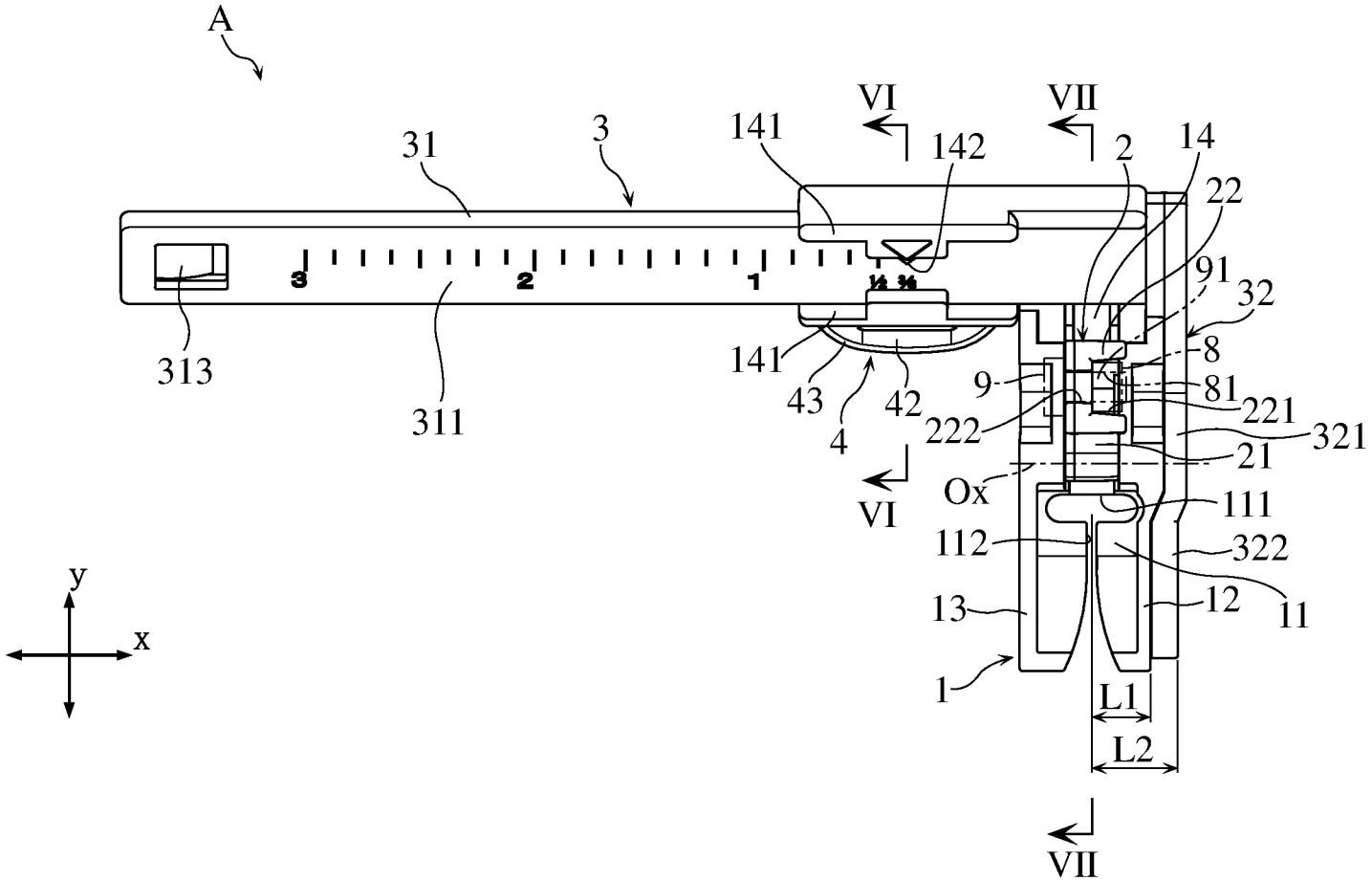
FIG. 2 is a plan view of the guiding tool shown in FIG. 1.
Figure 3:
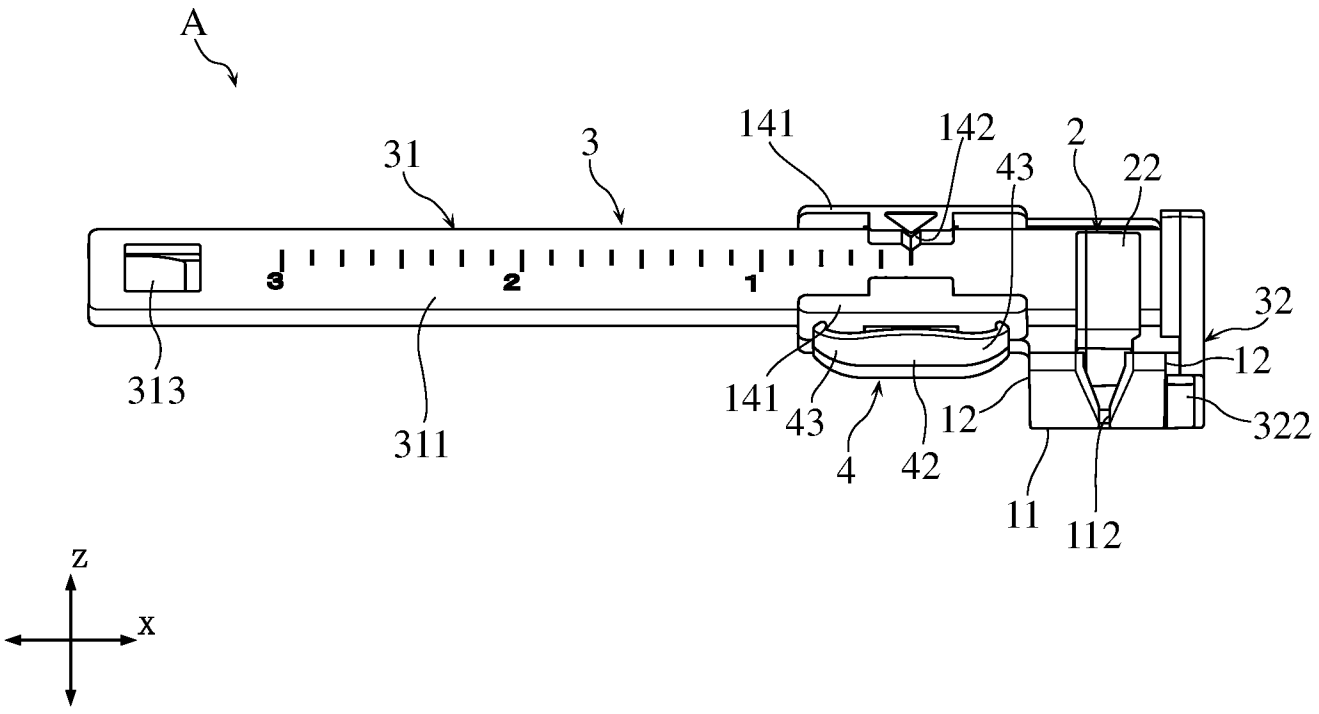
FIG. 3 is a front view of the guiding tool shown in FIG. 1.
Figure 4:
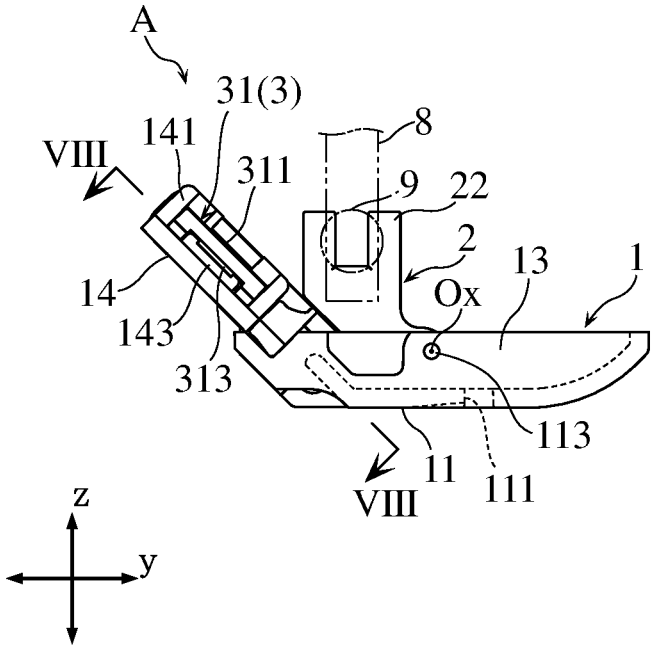
FIG. 4 is a side view of the guiding tool shown in FIG. 1.

The slit 112 communicates with the needle-passing hole 111 and extends forward (downward in FIG. 2) from the needle-passing hole 111 to reach the front end of the bottom wall 11. The slit 112 is approximately at the center of the bottom wall 11 in the direction x. As shown in FIGS. 3 and 4, the extremity of the portion of the bottom wall 11 that is divided by the slit 112 is inclined upward. As shown in FIGS. 2 and 3, the slit 112 becomes wider toward the front at the extremity.

The side walls 12 and 13 are spaced apart from each other in the direction x. The side walls 12 and 13 are formed integrally on the upper surface of the bottom wall 11 and stand along the respective side edges of the bottom wall 11 in the direction x. The side wall 12 is located at a first end (right end in FIGS. 2 and 3) of the bottom wall 11 in the direction x, whereas the side wall 13 is located at a second end (left end in FIGS. 2 and 3) of the bottom wall 11 in the direction x. In the present embodiment, each of the side walls 12 and 13 extends in the direction z at an angle of 90°, for example, with respect to the bottom wall 11. As shown in FIGS. 1 and 2, the side walls 12 and 13 are elongated in the direction y and extend substantially from the front end to the rear end of the bottom wall 11 (hence, of the presser foot 1). The height (the dimension in the direction z from the upper surface of the bottom wall 11) of each side wall 12, 13 is approximately the same at any point along the direction y.

Figure 7:
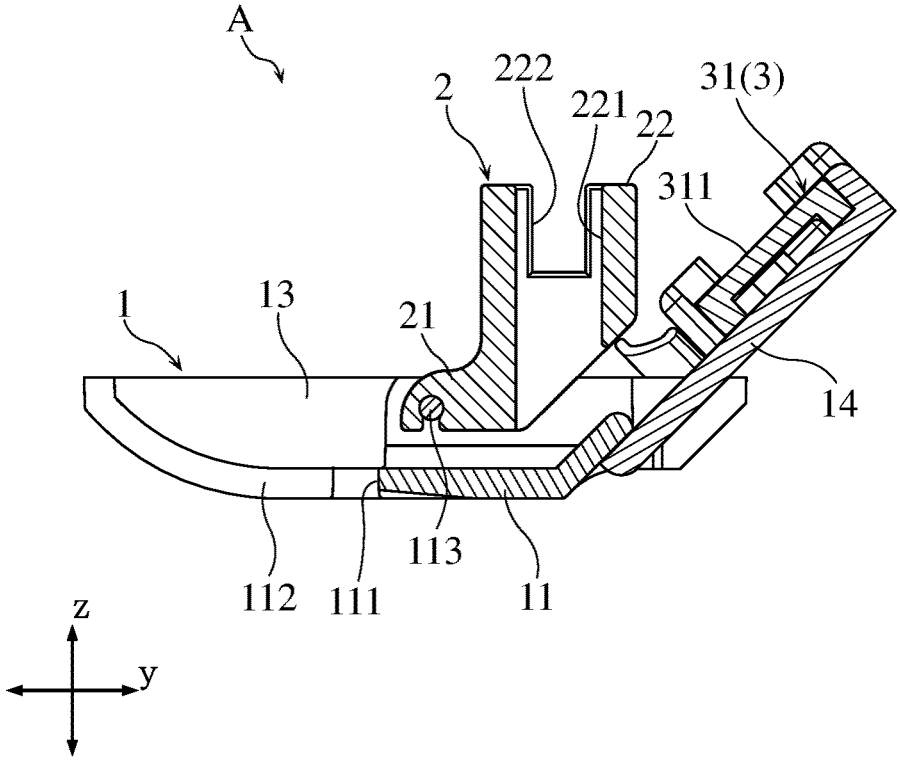
FIG. 7 is an enlarged sectional view taken along line VII-VII in FIG. 2.

The rear support 14 is connected to the rear of the bottom wall 11. As shown in FIGS. 1, 4 and 7, the rear support 14 has a plate-like shape as a whole and is inclined to become higher toward the rear (i.e., toward the left in FIG. 4 and toward the right in FIG. 7). The rear support 14 extends from the rear of the bottom wall 11 toward the second side (left side in FIGS. 2 and 3) in the direction x. The rear support 14 supports the gauge 3 and includes a pair of rails 141, a dimension reader 142 and a stopper projection 143. The rear support 14 will be described later.

The holder 2 is pivotally connected to the presser foot 1. The holder 2 includes a connector portion 21 and a sewing machine-attachable portion 22. The connector portion 21 is formed with a connection hole in which a shaft member 113, which may be made of a metal, is inserted (see FIG. 7). Opposite ends of the shaft member 113 are fixedly inserted in the holes formed in the side walls 12 and 13, respectively. Thus, the connector portion (or the holder 2) is pivotally supported on the side walls 12 and 13 via the shaft member 113 extending in the direction x. The rotation axis Ox of the shaft member 113 is shown in FIGS. 1, 2 and 4.

The sewing machine-attachable portion 22 is connected to the connector portion 21 and used for attaching the holder 2 (and hence the guiding tool A) to a presser bar 8 of a sewing machine. The sewing machine-attachable portion 22 has a groove 221 and a cutout 222. As indicated by phantom lines in FIG. 2, to use the presser foot 1, the presser bar 8 is fitted in the groove 221. Then, the screw shaft 91 of a mounting screw 9 is screwed into a threaded hole 81 in the presser bar 8 through the cutout 222. By tightening the mounting screw 9, part of the sewing machine-attachable portion 22 is pinched between the head of the mounting screw 9 and the presser bar 8. In this way, the holder 2 (or the guiding tool A) is attached to the presser bar 8. Note that, for so-called low shank sewing machines, the size and shape of the presser bar are standardized.

The gauge 3 has a ruler plate 31 and a guide portion 32. The ruler plate 31 is flat as a whole and elongated in the direction x. The ruler plate 31 has a ruler surface 311, irregularities 312 and a stopper piece 313.

The ruler plate 31 is supported on the rear support 14 of the presser foot 1. Specifically, the ruler plate 31 overlaps with the rear support 14 and is located higher than the bottom wall 11. The ruler plate 31 is elongated in the direction x and inclined to become higher toward the rear. The front surface of the ruler plate 31, which faces diagonally upward, is the ruler surface 311. The ruler surface 311 has a scale for measuring a dimension along the longitudinal direction (direction x). The scale is in a predetermined dimensional unit such as inches (in) or millimeters (mm).

Apart of the ruler plate 31 is flanked by the paired rails 141 of rear support 14 in the width direction. The rails 141 extend in the direction x and are spaced apart from each other in the width direction of the ruler plate 31. Each rail 141 covers a part of an edge of the ruler plate 31 in the width direction and a part of the ruler surface 311. With such an arrangement, the ruler plate 31 is slidable along the direction x.

Figure 5:
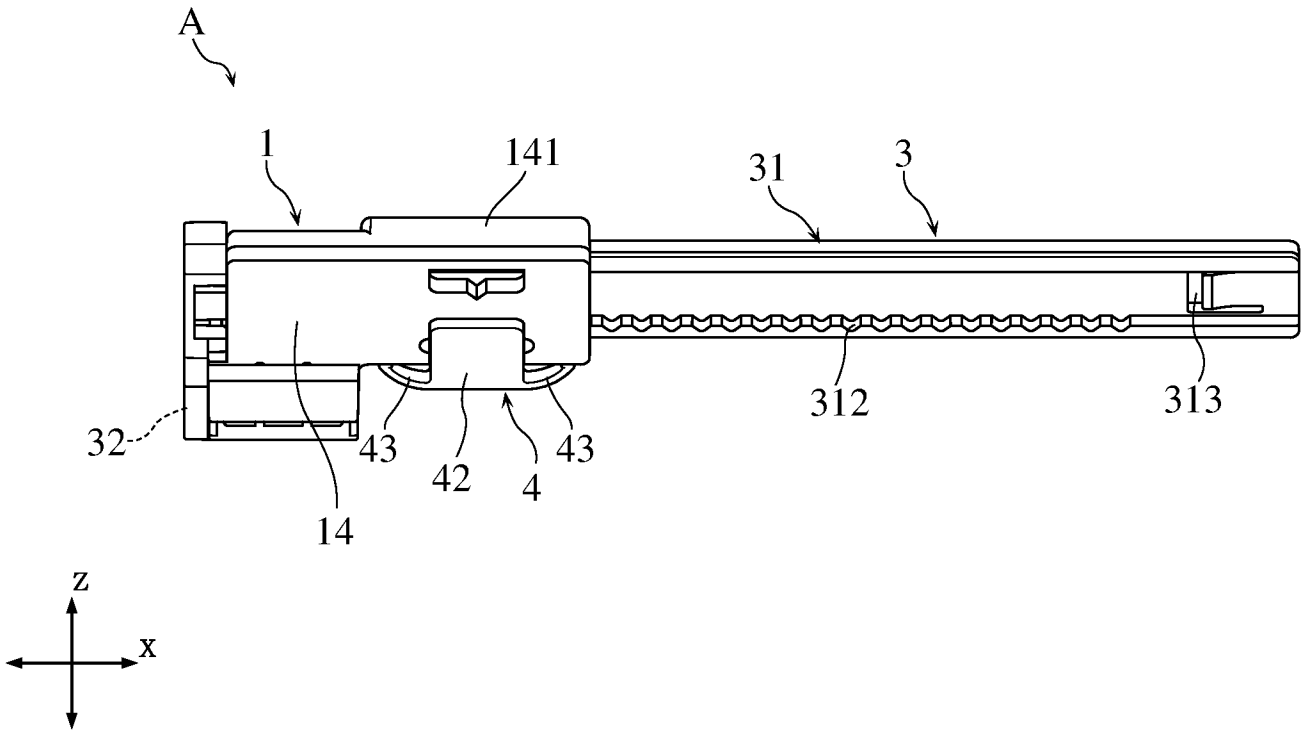
FIG. 5 is a rear view of the guiding tool shown in FIG. 1.
Figure 6:
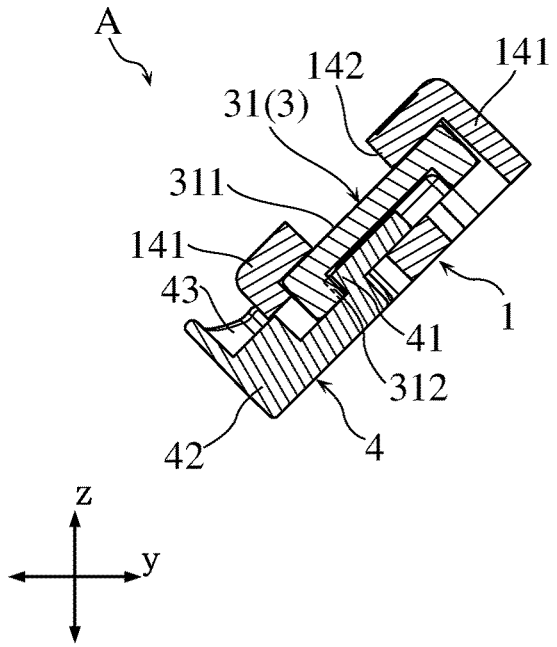
FIG. 6 is an enlarged sectional view taken along line VI-VI in FIG. 2.
Figure 8:
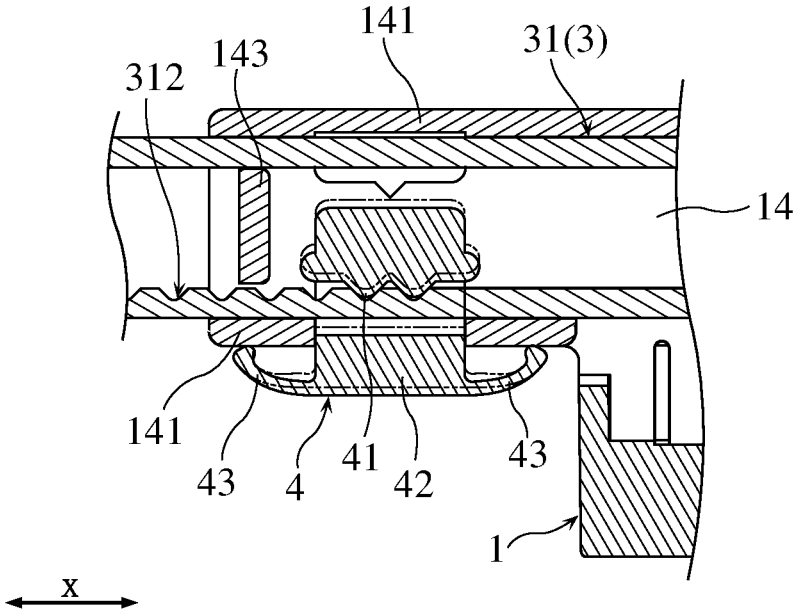
FIG. 8 is an enlarged sectional view taken along line VIII-VIII in FIG. 4.

As shown in FIGS. 5, 6 and 8, the irregularities 312 are formed at a surface of the ruler plate 31 that faces to the rear. The irregularities 312 are at a lower portion of the ruler plate 31 and arranged in a row along the direction x. Specifically, the irregularities 312 include projections and recesses that are alternately arranged at a predetermined pitch along the direction x. The function of the irregularities 312 is described later.

The stopper piece 313 is provided at the second end (i.e., the left end in FIGS. 2 and 3) in the direction x of the ruler plate 31. The stopper piece 313 is formed with a cutout at its periphery and hence elastically deformable. As shown in FIG. 4, apart of the stopper piece 313 projects rearward (toward the lower left in FIG. 4) in its natural state relative to the surrounding portions. On the other hand, the stopper projection 143 of the rear support 14 is provided at the second end (see FIG. 8) in the direction x of the rear support 14 and projects forward relative to the surrounding portions. When the ruler plate 31 is slidably supported on the rear support 14 and moved toward the second end in the direction x relative to the rear support 14, the stopper piece 313 engages with the stopper projection 143 to prevent the ruler plate 31 from dropping. The ruler plate 31 can be attached to or released from the rear support 14 by pressing the stopper piece 313 toward the front (toward the upper right in FIG. 4).

The guide portion 32 extends forward (downward in FIG. 2) from the first end (right end in FIG. 2) in the direction x of the ruler plate 31. In sewing, the guide portion 32 is aligned with stitches.

In the present embodiment, the guide portion 32 includes a proximal portion 321 and a distal portion 322. The first end in the direction x (right end in FIG. 2) of the distal portion 322 is recessed relative to the proximal portion 321. Accordingly, the second end in the direction x (left end in FIG. 2) of the distal portion 322 projects in the direction x. Each of the proximal portion 321 and the distal portion 322 extends along the y direction.

As shown in FIG. 2, the first end of the side wall 12 in the direction x (right end in FIG. 2) is partially recessed to conform to the shape of the distal portion 322. When the ruler plate 31 is slid as much as possible toward the second end in the direction x, the distal portion 322 comes into contact with or adjoins the bottom wall 11 and the side wall 12. In this state, the dimension L1 from the center of the needle-passing hole 111 to the first end (right end in FIG. 2) of the side wall 12 is ¼ inch or 7 mm, for example. The dimension L2 from the center of the needle-passing hole 111 to the first end (right end in FIG. 2) of the distal portion 322 is ⅜ inch or 10 mm, for example.

The engagement member 4 is provided for allowing stepwise sliding movement of the ruler plate 31 in the direction X. As shown in FIGS. 2, 3, 6 and 8, the engagement member 4 includes an engagement portion 41, a button 42, and a pair of resilient pieces 43. The engagement portion 41 faces the above-described surface of the ruler plate 31 that faces to the rear, through an opening formed in the rear support 14. As will be understood from FIGS. 6 and 8, the engagement portion 41 has irregularities of a pitch corresponding to the irregularities 312 of the ruler plate 31 and hence engages with the irregularities 312. The paired resilient pieces 43 flank the button 42 in the direction x. When the ruler plate 31 is set to a predetermined position and the engagement portion 41 engages with the irregularities 312, the resilient pieces 43 resiliently keeps the engagement portion 41 in pressure contact with the irregularities 312. In this way, the engagement portion 41 is in resilient engagement with the irregularities 312.

When the ruler plate 31 is slid relative to the rear support 14 in the direction x, the engagement portion 41 of the engagement member 4 moves resiliently relative to the irregularities 312 of the ruler plate 31. In this process, resistance is exerted to the sliding movement of the ruler plate 31 so that the ruler plate 31 can be moved incrementally or step by step.

Such an arrangement allows the ruler plate 31 to be moved relative to the rear support 14 step by step by a predetermined distance corresponding to the pitch of the irregularities 312. For example, the pitch of the irregularities 312 is set to ⅛ inch or 1 mm. The scale on the ruler surface 311 of the ruler plate 31 is set to correspond to the pitch of the irregularities 312. In the example shown in the drawings, the scale is in ⅛ inch increments.

As shown in FIG. 5 (see also FIG. 2), the button 42 is disposed opposite to the guide portion 32 with respect to the presser foot 1 in the direction x. The button 42 is used to switch the position of the engagement portion 41 between two states, i.e., a first state in which it engages the irregularities 312 and a second state in which it does not engage the irregularities 312. As will be understood from FIG. 8, when the button 42 is pressed, the engagement portion 41 moves away from the irregularities 312 against the elastic recovery force of the resilient piece 43 to disengage from the irregularities 312. The phantom lines in FIG. 8 illustrate the engagement member 4 in the state where the button 42 is pressed.

The dimension reader 142 of the rear support 14 points to a position on the scale of the ruler plate 31. The dimension reader 142 projects from one of the rails 141 to overlap with the ruler surface 311. The reading on the scale at the position which the dimension reader 142 points represents the dimension from the center of the needle-passing hole 111 to the first end (right end in FIG. 2) of the distal portion 322 of the guide portion 32. In the present embodiment, the rear support 14 and the bottom wall 11 of the presser foot 1 are formed separately and then fitted together. Alternatively, the rear support 14 and the bottom wall 11 of the presser foot 1 may be integrally formed.

For example, the above-described guiding tool A is made of a synthetic resin having an appropriate strength. For example, the presser foot 1, the holder 2, the gauge 3 and the engagement member 4 are formed separately by resin molding.

The use and advantages of the guiding tool A are described below with reference to FIG. 9.

To use a sewing machine, the guiding tool A is attached to the presser bar 8 of the sewing machine. Specifically, the holder 2 of the guiding tool A is attached to the presser bar 8. Generally, the presser bar is standardized for so-called low shank sewing machines. Thus, the guiding tool A according to the present embodiment can be used for various types of low shank sewing machines, and hence has improved versatility.

Figure 9:
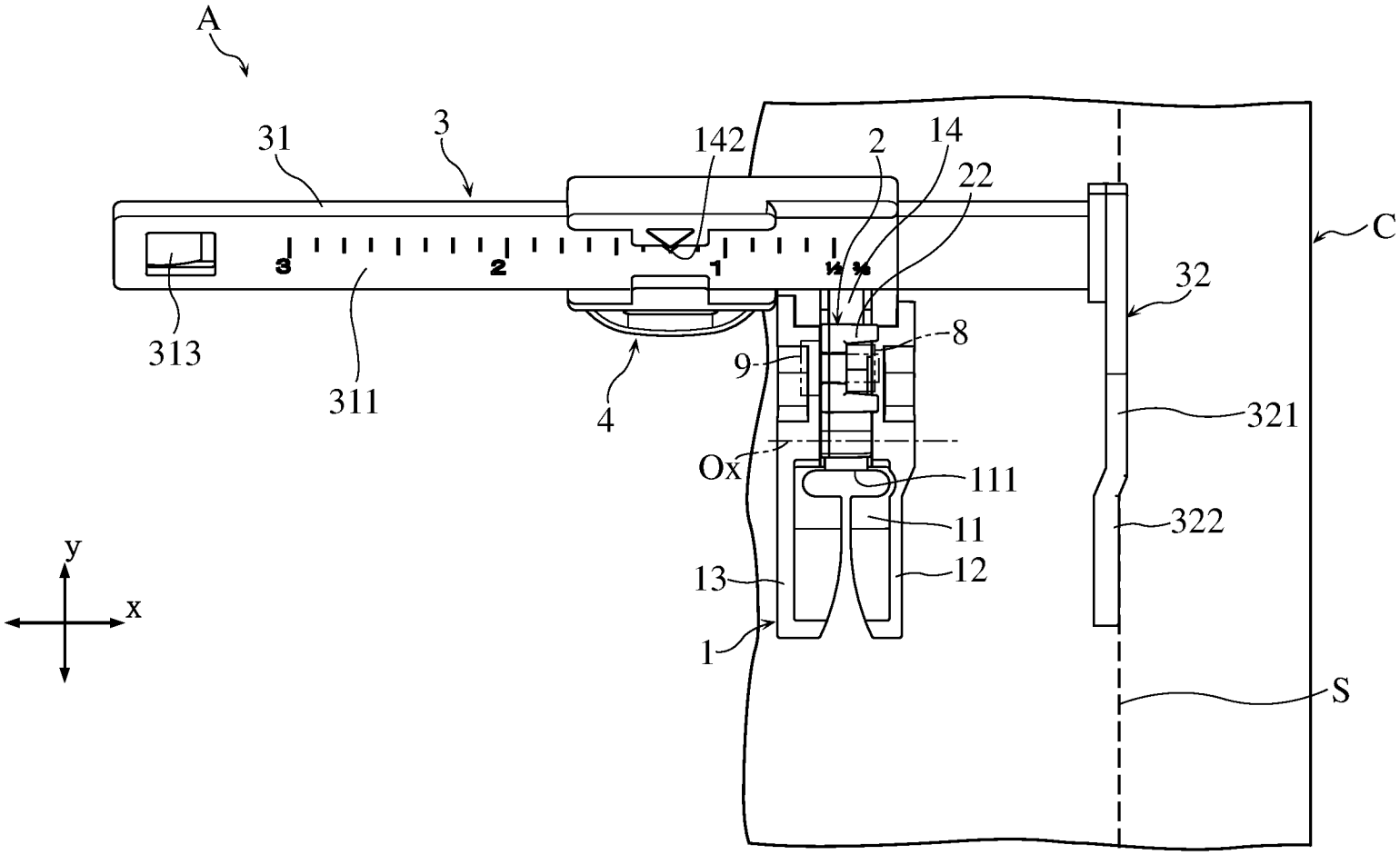
FIG. 9 is a plan view showing the guiding tool of FIG. 1 in use.

As shown in FIG. 9, to use the guiding tool A, the ruler plate 31 of the gauge 3 is slid relative to the rear support 14 in the direction x to place the guide portion 32 at a predetermined distance from the sewing-machine needle. Sewing is performed with a line of stitches formed in the fabric C aligned with the guide portion 32.

The ruler surface 311 of the ruler plate 31 is inclined to become higher toward the rear. Thus, the person performing the sewing can easily see the ruler surface 311, which is convenient. Moreover, the ruler plate 31 is supported on the rear support 14 at a position higher than the bottom wall 11. Thus, the ruler plate 31 is reliably spaced apart from the fabric and does not cause a resistance to nor hinder the feeding of the fabric.

In the guide portion 32, the first end (right end in FIG. 2) in the direction x of the distal portion 322 is recessed relative to the proximal portion 321. Such an arrangement reduces the dimension from the center of the needle-passing hole 111 to the first end (right end in FIG. 2) of the distal portion 322 in the direction x in the state where the ruler plate 31 is moved as much as possible toward the second side in the direction x. This allows for setting the dimension from the center of the needle-passing hole 111 to the first end of the distal portion 322 in the direction x to be equal to a relatively small stitching interval often used for "stitch sewing", such as ⅜ inch or 10 mm, as described above with reference to FIG. 2.

Figure 10:
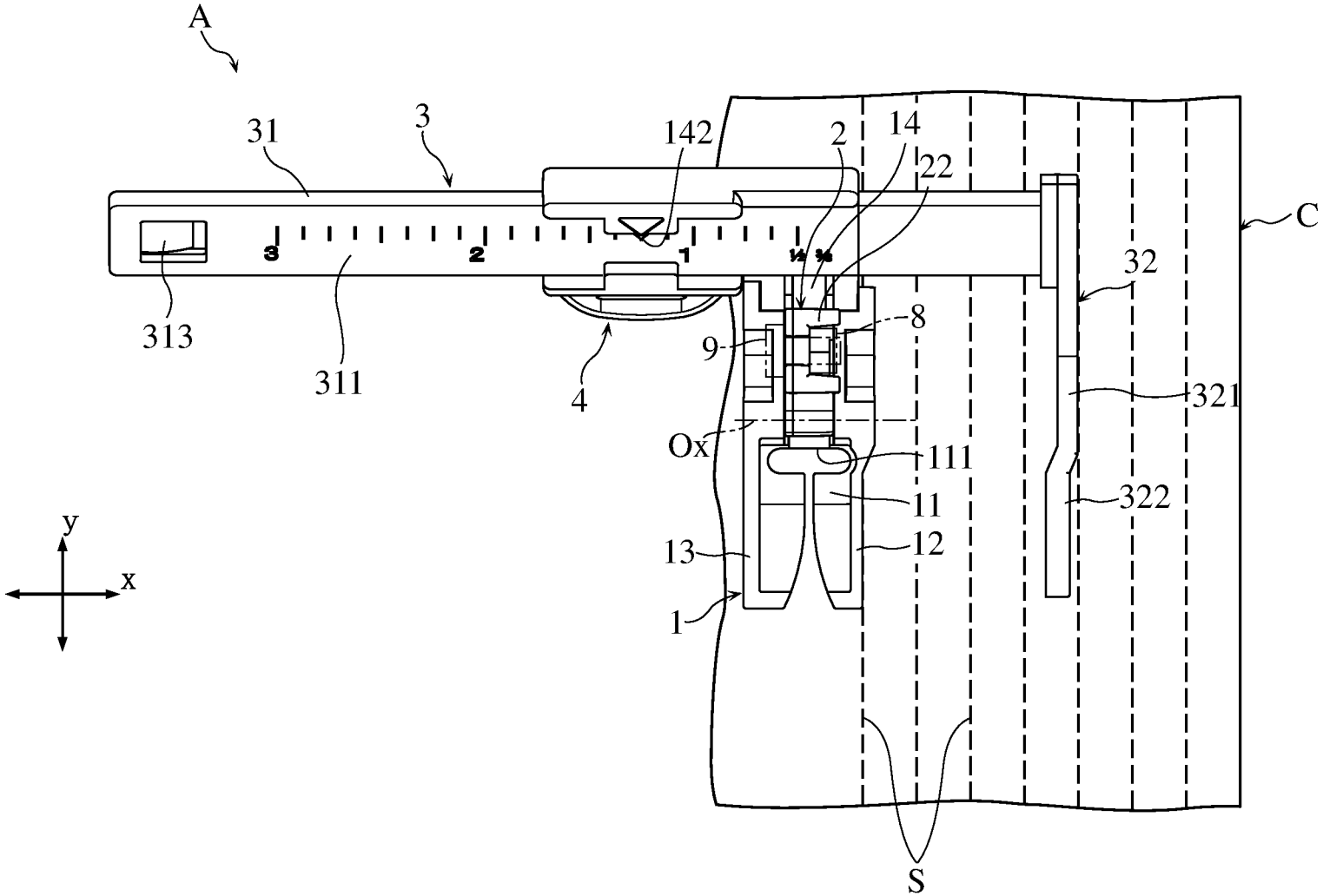
FIG. 10 is a plan view showing the guiding tool of FIG. 1 in use.

The distal portion 322 of the guide portion 32 projects toward the second side in the direction x (toward the left in FIG. 2). Moreover, the first end of the side wall 12 in the direction x (right end in FIG. 2) is partially recessed to conform to the shape of the distal portion 322. Such an arrangement allows the dimension L1 from the center of the needle-passing hole 111 to the first end (right end in FIG. 2) of the side wall 12 in the direction x to be relatively small (e.g. ¼ inch or 7 mm), while securing for the distal portion 322 the approximately same dimension in the direction x as the proximal portion 321. As shown in FIG. 10, sewing may be performed with a line of stitches in the fabric C aligned with the side wall 12. With the above-described arrangement, lines of stitches S can be formed at relatively narrow intervals such as ¼ inch or 7 mm often used for "stitch sewing".

The guiding tool A has the engagement member 4. The engagement member 4 allows stepwise sliding movement of the ruler plate 31 so that the ruler plate 31 is easily placed at a desired position. Moreover, the ruler plate 31 is elongated in the direction x. Thus, the dimension from the center of the needle-passing hole 111 to the guide portion 32 is adjustable within a relatively wide range.

The ruler plate 31 has irregularities 312 arranged in a row (or in a slight line), and the engagement member 4 is provided with the engagement portion 41 that resiliently engages with the irregularities 312. Such an arrangement makes it possible to precisely adjust the dimension from the center of the needle-passing hole 111 to the guide portion 32 at a predetermined pitch. By pressing the button 42 of the engagement member 4, the engagement portion 41 is disengaged from the irregularities 312. In this state, quick sliding movement of the ruler plate 31 is possible.

The guiding tool according to the present disclosure is not limited to the foregoing embodiments. The specific configuration of each part of the guiding tool according to the present disclosure may be varied in many ways without departing from the scope of the disclosure as defined by the appended claims.

The invention claimed is:

1. A guiding tool for a sewing machine, the guiding tool comprising:

a presser foot including a bottom wall and a rear support, the bottom wall including a front end and a rear end, the bottom wall being formed with a needle-passing hole between the front end and the rear end, the bottom wall being formed with a slit extending from the needle-passing hole to the front end, the rear support being held in direct contact with and connected to the rear end of the bottom wall;

a holder that is removably attached to a presser bar of the sewing machine and that holds the presser foot in a manner such that the presser foot together with the rear support is capable of pivoting about a horizontal axis; and a gauge supported by the rear support in a manner slidable in a first direction parallel to the horizontal axis, the gauge including a ruler plate and a guide portion, the ruler plate having a ruler surface marked with a scale, the guide portion extending from the ruler plate, wherein the ruler plate is disposed above the bottom wall in a vertical direction, and the ruler surface is inclined so as to become higher as proceeding rearward.

2. The guiding tool according to claim 1, wherein the guide portion extends forward from an end of the ruler plate, and the guide portion includes a distal portion and a proximal portion that is closer to the end of the ruler plate than is the distal portion, the distal portion being dislocated relative to the proximal portion in the first direction.

3. The guiding tool according to claim 2, wherein the presser foot includes a side wall connected to a side edge of the bottom wall.

4. The guiding tool according to claim 3, wherein the side wall includes a recessed portion accommodating the distal portion of the guide portion.

5. The guiding tool according to claim 1, further comprising an engagement member configured to allow stepwise sliding movement of the ruler plate.

6. The guiding tool according to claim 5, wherein the ruler plate is formed with irregularities arranged in a row, and the engagement member comprises an engagement portion and a button, the engagement portion being capable of resilient engagement with the irregularities, the button being capable of switching a position of the engagement portion between a state in which the engagement portion engages the irregularities and another state in which the engagement portion does not engage the irregularities.

7. The guide tool according to claim 6, wherein the button is disposed on an opposite side of the presser foot relative to the guide portion, in the first direction.

* * * * *